US007798066B1

(12) United States Patent
Nofsinger et al.

(10) Patent No.: US 7,798,066 B1
(45) **Date of Patent: *Sep. 21, 2010**

(54) MOTORIZED PYROTECHNIC SYSTEM

(75) Inventors: Reid Nofsinger, Elgin, IL (US); Mark J. Grega, Bartlett, IL (US)

(73) Assignee: Strictly FX, Elk Grove Village, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/371,061

(22) Filed: Feb. 13, 2009

Related U.S. Application Data

(63) Continuation of application No. 11/184,103, filed on Jul. 19, 2005, now Pat. No. 7,509,910.

(51) Int. Cl.
*F42B 4/06* (2006.01)

(52) U.S. Cl. ..... 102/361; 102/355; 89/1.815

(58) Field of Classification Search ..... 89/1.815, 89/1.816, 1.34, 1.802; 102/335, 342, 361; 86/20.1

See application file for complete search history.

(56) References Cited

U.S. PATENT DOCUMENTS

| | | | |
|---|---|---|---|
| 5,487,706 | A | 1/1996 | Wilk |
| 5,691,500 | A | 11/1997 | Mancini |
| 6,490,977 | B1 | 12/2002 | Bossarte et al. |
| 6,530,327 | B2 | 3/2003 | Hiskey et al. |

*Primary Examiner*—Benjamin P Lee
(74) *Attorney, Agent, or Firm*—Drinker Biddle & Reath LLP

(57) ABSTRACT

One aspect of the invention provides a firing apparatus that provides an arcuate visual effect. The firing apparatus includes a motor, an enclosure housing the motor and an arm connected to a shaft of the motor for moving a pyrotechnic device such as a gerb. Another aspect of the invention provides a pyrotechnic system that includes a firing apparatus including a reciprocal motor, a firing arm having a first end connected to a shaft of the reciprocal motor and a second end adapted to emit an arcuate pyrotechnic effect, a control unit in communication with the firing apparatus for controlling operation of the reciprocal motor and an ignition unit in communication with the firing apparatus for initiating the pyrotechnic effect.

14 Claims, 6 Drawing Sheets

MOTORIZED PYROTECHNIC SYSTEM

CROSS-REFERENCE TO RELATED APPLICATIONS

This application is a continuation of parent application Ser. No. 11/184,103, filed Jul. 19, 2005. The parent application is herein incorporated by reference.

BACKGROUND

The present invention relates generally to systems and methods for providing visual effects, and more particularly to a motorized pyrotechnic system.

The fireworks industry has employed black powder-based pyrotechnic compositions in both stationary and projectile forms in the past to produce various different types of pyrotechnic displays. One common pyrotechnic that is used in pyrotechnic displays is a "gerb."

As known in the art, a gerb is a tube that is sealed at one end, has a nozzle at the other end and is filled with a pyrotechnic mixture containing at least an oxidant and a fuel. A gerb is somewhat similar to a rocket, providing a pyrotechnic effect that is similar to a vertical spray or fountain of flame, sparks or stars. However, unlike a rocket, a gerb is typically used as a stationary portion of a set piece and does not move. As is known, the nozzle, choke or restriction portion of the gerb increases the internal pressure to give more height to the spray of sparks and flame and to generally improve the burning efficiency of the pyrotechnic mixture. Gerbs typically include a clay nozzle with a prime situated adjacent the clay nozzle and in contact with an ignition source, such as an electric match, located within the nozzle opening. Other gerb structures are, of course, known and available in the marketplace.

In the past, gerbs typically have been used in stationary platforms to send sparks and flames upwardly from 5 to 45 feet and for short durations (e.g., less than thirty seconds). Although gerbs are generally used as stationary portions of set pieces, a specialized gerb known as a driver is used to provide motive force to a moving portion of a set piece, for example a wheel rotating in a vertical plane, such as a Catherine wheel or flying saucer. Such wheels and rotating pieces rely on an arrangement of gerbs, for example, three drivers arcuately separated from each other by one hundred twenty degrees about the wheel perimeter, to give sufficient motive force to turn the wheel, thereby providing a ring of fire visual effect.

While gerbs are commonly available and generally inexpensive, the range of pyrotechnic displays currently achievable with gerbs is fairly limited. Therefore, if a method and system were provided to substantially increase the range of visual effects achievable with gerbs, an important contribution to the art would be at hand.

SUMMARY

One aspect of the invention provides a firing apparatus that includes a motor, an enclosure housing the motor and an arm including a proximal end that is attached to a shaft of the motor that projects through the enclosure, a distal end adapted to receive a pyrotechnic device and a body portion including an ignition contact for firing the pyrotechnic device. The enclosure includes a motor control interface for receiving a signal from a control unit located remotely from the firing apparatus for operating the motor and an ignition interface connected with the ignition contact for receiving a signal from an ignition unit that is located remotely from the firing apparatus. Another aspect of the invention provides a pyrotechnic system that includes a firing apparatus including a reciprocal motor, a firing arm having a first end connected to a shaft of the reciprocal motor and a second end adapted to emit an arcuate pyrotechnic effect, a control unit in communication with the firing apparatus for controlling operation of the reciprocal motor and an ignition unit in communication with the firing apparatus for initiating the pyrotechnic effect.

BRIEF DESCRIPTION OF THE DRAWINGS

The present invention is described with reference to the accompanying figures, which illustrate embodiments of the present invention. However, it should be noted that the invention as disclosed in the accompanying figures and appendices is illustrated by way of example only.

DETAILED DESCRIPTION OF THE EMBODIMENTS

Figure 1:
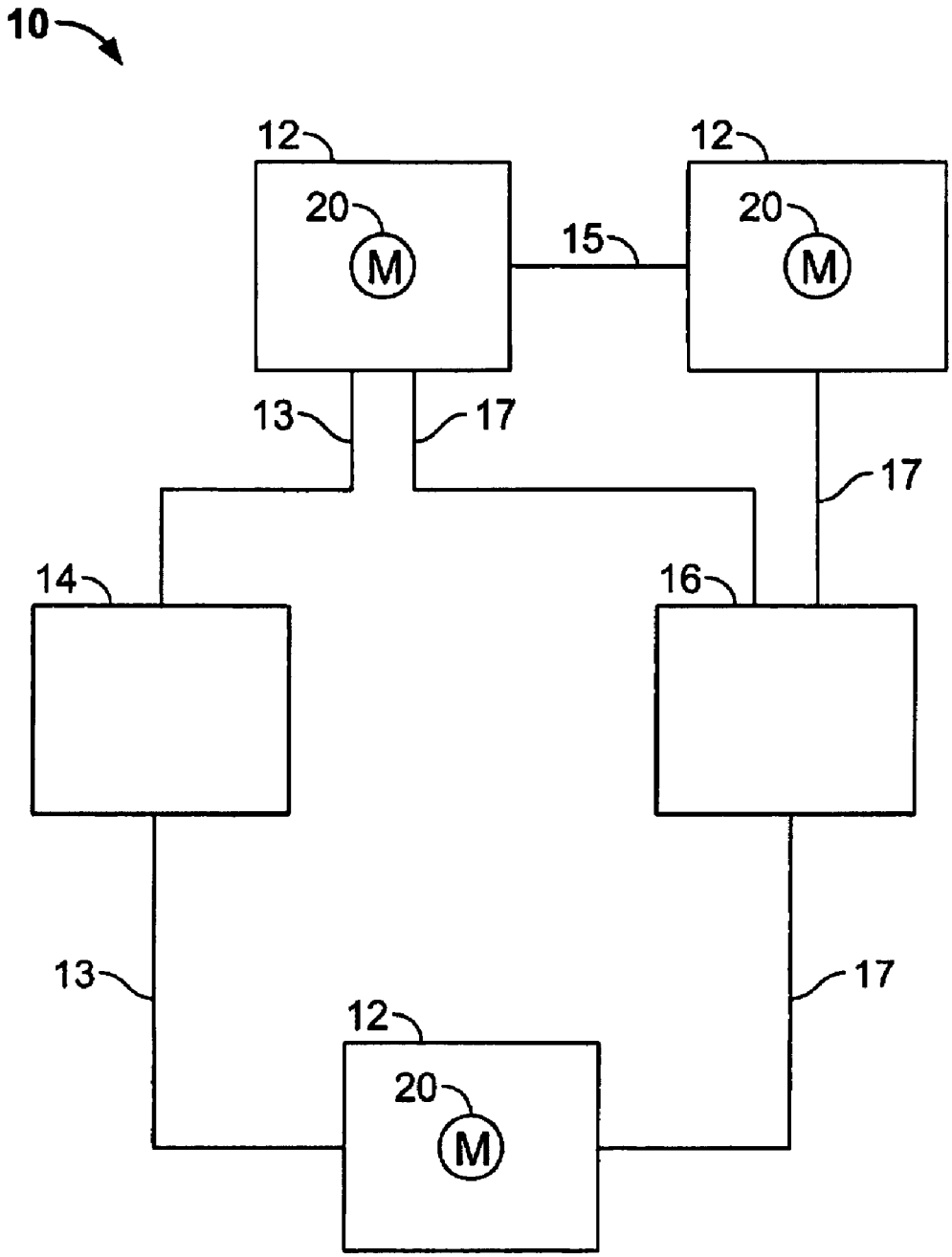
FIG. 1 is a block diagram of an example pyrotechnic firing system.
Figure 2:
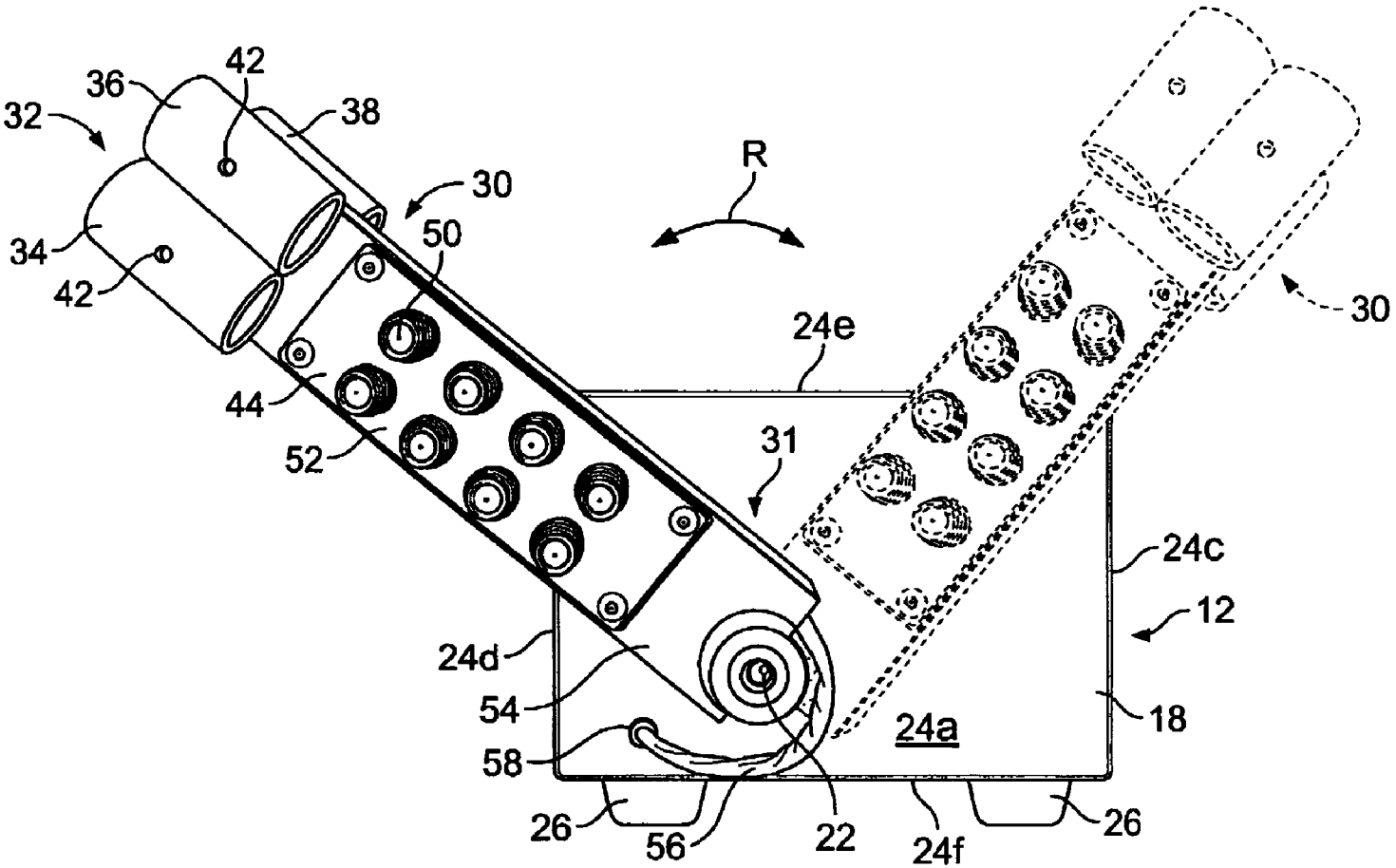
FIG. 2 is a front elevation view of an example motorized firing unit for use in the system of FIG. 1.
Figure 3:
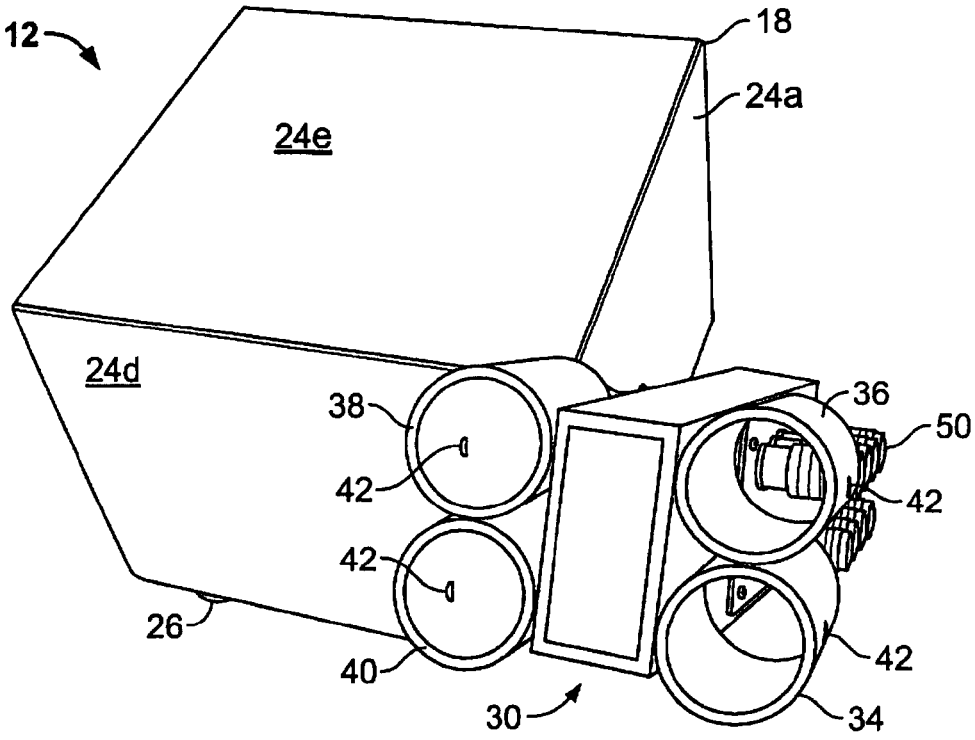
FIG. 3 is a top perspective view of the example motorized firing unit of FIG. 2.
Figure 4:
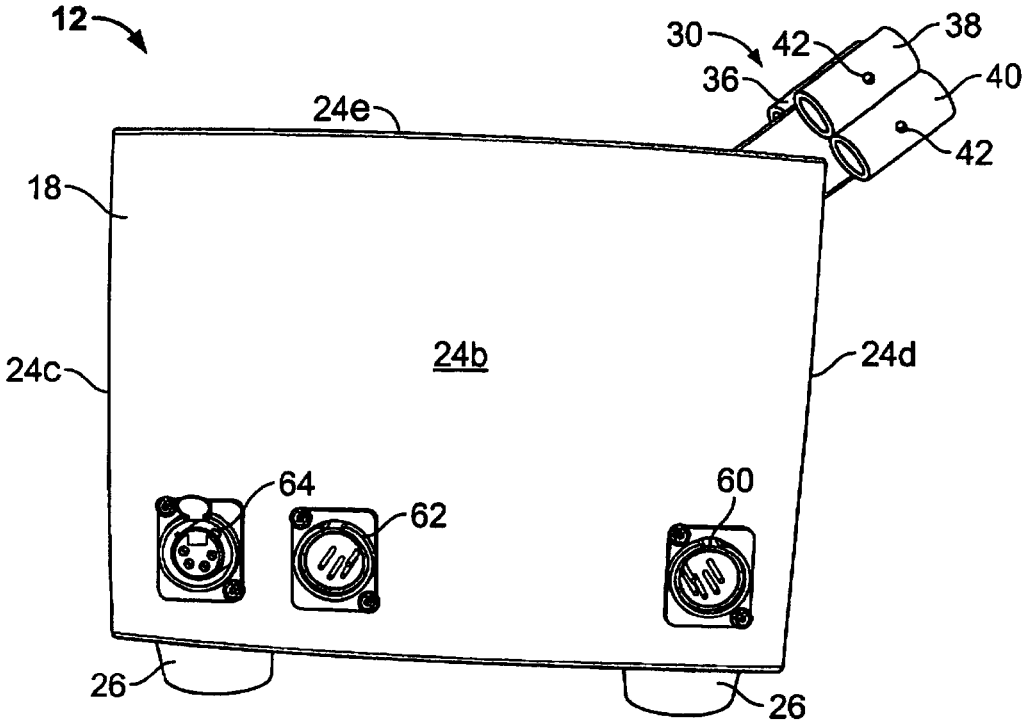
FIG. 4 is a rear elevation view of the example motorized firing unit of FIG. 2.

Referring now to the Figures and particularly to FIG. 1, a motorized pyrotechnic system 10 is provided. As shown, the motorized pyrotechnic system 10 includes one or more firing apparatuses 12 for producing a visual effect, a control unit 14 for operating the firing apparatuses 12 and an ignition unit 16. Each of the firing apparatuses 12 includes a motor 20 for movement of a pyrotechnic device (e.g., a gerb) to produce a visual effect. An example firing apparatus 12 is illustrated in FIGS. 2-4 and discussed hereafter in further detail. The control unit 14 is linked with each firing apparatus 12 by a wired link 13 for providing one or more of operational power and control signals to the motor 20 for producing a desired visual effect with the pyrotechnic device. Although the control unit 14 is illustrated as communicating with each firing apparatus 12 via a wired link 13 (e.g., a patch cord, cable or the like), the control unit may alternatively communicate with one or more of the firing apparatuses 12 via a wireless link (e.g., a radio frequency or infrared channel). For example, the control unit 14 may include an RF transmitter and the firing apparatus 12 may include a RF receiver and be powered by an internal battery or a commercial power source (e.g., a 120V AC outlet).

The control unit 14 may independently control a plurality of firing apparatuses 12 via one or more wired links 13 or wireless links. For example, the control unit 14 may control a total of eight firing apparatuses that are arranged in two set pieces each having four firing apparatuses. Further as can be appreciated from FIG. 1, any number of firing apparatuses may be connected in series or "daisy-chained" by a wire 15 such as a jumper cable and controlled by the control unit 14. Indeed, the system 10 can provide for a wide range of visual effects since the control unit 14 may control many firing apparatuses 12 and many configurations of firing apparatuses 12 (e.g., series-connected, independently-connected and various combinations thereof).

As known in the art, the ignition unit 16 initiates the ignition of a pyrotechnic device electronically. The ignition unit 16 typically includes a power source such as a battery or energy-storage capacitor, electronics and a firing button for outputting a voltage or current to a fuse such as an electronic match (e-match), thereby electronically igniting the pyrotechnic device. The ignition unit 16 is located remotely from the control unit 14 and the firing apparatuses 12 to ensure the safety of the operator. As shown, the ignition unit 16 communicates with each of the firing apparatuses 12 via a wired link 17, but may alternatively communicate an ignition signal to one or more of the firing apparatuses 12 via a wireless (e.g., RF) communication link. Example ignition units are available from Le Maitre Special Effects Inc. of Ontario, Canada, Luna Tech Inc. of Owens Cross Roads, Ala. and FireOne, Pyrotechnics Management Inc. of State College, Pa. As can be appreciated, the firing apparatuses 12, control unit 14 and ignition unit 16 all conform to pyrotechnic industry standards.

An example firing apparatus 12 is illustrated in further detail in FIGS. 2-4. The illustrated firing apparatus 12 includes an enclosure 18 in which a motor 20 (FIG. 1) is located and a firing arm 30 coupled with the motor 20. As can be appreciated from FIGS. 2-4, the enclosure 18 includes a front face 24*a*, a rear face 24*b*, a right face 24*c*, a left face 24*d*, a top face 24*e* and a bottom face 24*f* and has a generally cube-shaped appearance. Of course, the enclosure 18 may be sized and shaped otherwise as desired, for example, a parallelepiped shape. The enclosure 18 may be made of any suitable material known in the art, for example, metal such as steel or aluminum. Further, one or more of the faces 24*a*-24*f* (e.g., top face 24*e*) may be detachably affixed so that it can be removed for repairing and/or replacing the motor 20 housed within the enclosure. As shown in FIGS. 2 and 4, supports 26 such as rubber feet are attached to the four corners of the bottom face 24*f* to provide stability and prevent accidental movement of the firing apparatus 12 during operation. Moreover, while the weight of the enclosure 18 and motor 20 therein is sufficient to ballast the firing apparatus 12 to obviate movement thereof, means may be provided for affixing the enclosure in place, such as by passing fasteners such as bolts or screws through portions of the enclosure 18 into a stationary supporting surface. For example, the firing apparatus 12 may be affixed to any type of vertical, horizontal or inclined surface or structure such as a column, pole, truss, beam, channel, unistrut or the like.

As best shown in FIG. 2, a shaft 22 of the motor 20 (FIG. 1) projects from the interior of the enclosure and through the front face 24*a* for coupling with the firing arm 30. Motor 20 produces reciprocating motion of the shaft 22 of up to about 180°. Thus, as can be appreciated from the illustrated embodiment of firing apparatus 12 in FIG. 2, one example motor 20 imparts a reciprocal arcuate motion to the firing arm 30 that moves the firing arm 30 back and forth through an angle of approximately 90° as indicated by the double-headed arrow R and the solid and broken-line depictions of firing arm 30. That is, the motor 20 moves the firing arm 30 through two substantially similar angles of approximately 45° on each side of a vertical axis that bisects the arcuate path of the firing arm 30. As can be appreciated, the motor 20 may provide for various movements of the firing arm 30 through both acute and obtuse angles. In one example, the motor 20 may move the firing arm 30 back and forth through an angle of 90° starting from either a generally vertical position or a generally horizontal position. In another example, the motor 20 may move the firing arm 30 back and forth through an angle of 180° from one horizontal position to a diametrically-opposed horizontal position. Indeed, the motor 20 may be controlled, adjusted or selected to provide a predetermined or variable arcuate movement of the firing arm 30, thereby achieving a corresponding visual effect. Example motors for use with the firing apparatus 12 may be heavy-duty windshield wiper-type motors from Window Wiper Technologies of Mystic, Conn. that are used for boat applications, but other motors may be suitable as well.

As shown in FIG. 2, the firing arm 30 is a rectangular-shaped tube and attached at its proximal end 31 to the shaft 22 of motor 20. Distal end 32 of the firing arm 30 includes four receiving tubes, but fewer or additional receiving tubes may be provided. As shown in FIG. 3, the receiving tubes are arranged such that receiving tubes 34 and 36 are on the front side of firing arm 30 and receiving tubes 38 and 40 are on the back side of firing arm 30, but the receiving tubes 34, 36, 38, 40 may be arranged otherwise as desired. Each of the receiving tubes 34, 36, 38, 40 is dimensioned to receive a gerb therein, but may be dimensioned otherwise to accept another pyrotechnic device (e.g., a comet, mine, flare, etc.) or various combinations of pyrotechnic devices. In one example, aluminum tubes with a one inch inside diameter and a ⅛ inch or better wall thickness could be used to retain a gerb or other tube-type pyrotechnic device. As shown in FIGS. 2-4, each tube 34, 36, 38, 40 includes a threaded bore 42 through the tube's sidewall for accepting a set screw (not shown) that is used to lock the gerb in place. The gerbs are mounted in these tubes and oriented with their nozzles directed distally (i.e., upward and outward from the enclosure 18) and their ignition wires protruding from the proximal ends of the tubes 34, 36, 38, 40. In some embodiments, the distal end of each of the receiving tubes 34, 36, 38, 40 may include a cap, floor, wall or web to prevent the gerb from falling out of the tubes. While any commercially-available gerbs may be used, one example gerb that may be used is a "10×20 silver gerb" that emits a silver fountain of sparks up to 20 feet in the air for a period of about ten seconds. Other gerbs may produce fountains to heights of about 5 to 45 feet for periods of about 1 to 20 seconds. Indeed, although the currently-described and illustrated embodiment of the firing apparatus 12 employs gerbs, the invention is not limited as such and it should be understood that other embodiments may employ other known pyrotechnic devices.

As best illustrated in FIG. 2, a plurality of contact pins 50 is disposed on the exterior of the lengthwise body portion 44 of the firing arm 30. As shown, the eight contact pins 50 are arranged in a two-by-four array on a connector plate 52, but fewer or additional contact pins 50 may be provided or arranged otherwise. As should be appreciated, each of the four pairs of contact pins 50 corresponds with a gerb inserted in each of the receiving tubes 34, 36, 38, 40 for independently igniting/firing each gerb. As shown, the contact pins 50 are of the spring-loaded type for holding a wire such as a fuse, e-match or the like and applying a voltage and/or current thereto. However, other suitable contacts may be substituted for the contact pins 50 such as screw posts, wire-wrapped/nailed connections and the like. As known in the art, each pin of the pair of contact pins 50 is color coded and includes a red contact pin, which is the "hot" pin for delivering the firing or ignition signal, and a black contact pin, which is the "common", neutral or ground pin. Further, each pair of contact pins 50 may be labeled with indicia to help an operator identify or distinguish the gerbs.

The connector plate 52 is attached to the outer face 54 of the firing arm 30. The connector plate covers an aperture (not shown) in the outer face 54 of the firing arm 30 through which insulated conductors (not shown) terminate and attach to each of the contact pins 50 for delivering the firing voltage or signal. These insulated conductors exit the firing arm 30 at its proximal end 31 through a flexible shield 56 that protects the insulated conductors. The flexible shield 56 enters the interior of the enclosure 18 through a grommet 58 in front face 24*a*. The insulated conductors pass through the enclosure 18 from the front face 24*a* to terminate at an interface (e.g., jack, port, or the like) on the back face 24*b*.

Referring now to FIG. 4, the rear face 24*b* of the enclosure 18 of the firing apparatus 12 is illustrated. As shown, the rear face 24*b* of the enclosure 18 includes three interfaces 60, 62, 64, but fewer or additional interfaces may be provided. Interfaces 60, 62, 64 are embodied as four-pin XLR-type ports, but the interfaces 60, 62, 64 may be other types of input and output ports or jacks known in the art, such as, for example, RJ11, RJ45, DB9 and DB25. As shown, the interfaces (i.e., jacks) 60 and 62 are male for accepting a corresponding female plug of a cable, whereas the interface (i.e., jack) 64 is female for accepting a corresponding male plug of a cable. As can be appreciated from FIGS. 1 and 4, the interfaces 60, 62, 64 facilitate linking the firing apparatus 12 to the control unit 14, ignition unit 16 and, optionally, other firing apparatuses 12. As known in the art, female XLR-type jacks are used for outputs, whereas male XLR-type jacks are used for inputs. Thus, ignition interface 60 provides an input for coupling the firing apparatus 12 with the ignition unit 16 and motor control interface 62 provides an input for coupling the firing apparatus 12 with the control unit 14. In this way, a firing apparatus 12 receives at ignition interface 60 an ignition signal, voltage or current that is output from the ignition unit 16 and also receives at motor control interface 62 a motor control signal, voltage or current that is output from the control unit 14 for controlling operation of the motor 20. Further, interface 64 provides an output for coupling with the motor control interface 62 of another firing apparatus 12 to daisy-chain (i.e., connect in series) a number of firing apparatuses 12 together. As can be appreciated, a number of firing apparatuses that are daisy-chained together via interfaces 62 and 64 of each firing apparatus 12 will function substantially similarly (e.g., the motor 20 of each firing apparatus 12 will operate at the same speed).

Now, when the gerbs (not shown) are mounted in the tubes 34, 36, 38, 40, the ignition wires (not shown) for each of the gerbs are attached to the appropriate contact pins 50 so that they are ready for firing when desired. As can be appreciated, the contact pins 50 are interconnected with the ignition interface 60. Thus, when the ignition unit 16 is actuated by a remote operator, the ignition signal (e.g., voltage or current) is sent from the ignition unit 16 to the appropriate contact pins 50 via ignition interface 60 to ignite one or more of the gerbs. Depending on the visual effect that is desired, the gerbs may be fired simultaneously or sequentially. For example, the gerbs may be fired simultaneously if a large, bright effect is desired, whereas the gerbs may be fired sequentially if a longer-duration effect is desired. In another example, one gerb may be fired followed by two simultaneously-fired gerbs while saving the remaining gerb for later use, for example during a finale. Indeed, since gerbs are available in a variety of colors, burning durations and shower heights, one can appreciate that innumerable visual effects may be achieved.

In one example arrangement of two firing apparatuses 12, the apparatuses 12 cooperate to provide a desirable visual effect that is similar to a wall or curtain of sparks and flame. The same type of gerb is used in both of the apparatuses 12 and a first firing apparatus 12 is separated from a second firing apparatus 12 by a distance that is slightly less than twice the known shower height of the selected gerbs. The first and second firing apparatuses 12 are arranged in a mirror-image fashion such that the arm 30 of the first firing apparatus 12 is initially oriented toward the second firing apparatus 12 and the arm 30 of the second firing apparatus is initially oriented toward the first firing apparatus 12. As mentioned above, the first and second firing apparatuses may be independently controlled by the control unit 14 or may be daisy-chained together. Now, the gerbs of the first and second firing apparatuses 12 are ignited and the motors are energized and operated together so that the showers of the gerbs move in an arcuate fashion generally upward and downward to form converging and diverging fans of sparks and flame. Indeed, additional pairs of firing apparatuses 12 may be provided and physically arranged in a set piece to achieve a desired visual effect. In this way, one or more firing apparatuses 12 help create visual effects that have the appearance of using many stationary pyrotechnic devices, but are substantially safer, more reliably operated and generally less expensive than set piece visual effects that are created with stationary pyrotechnic devices alone.

Figure 5:
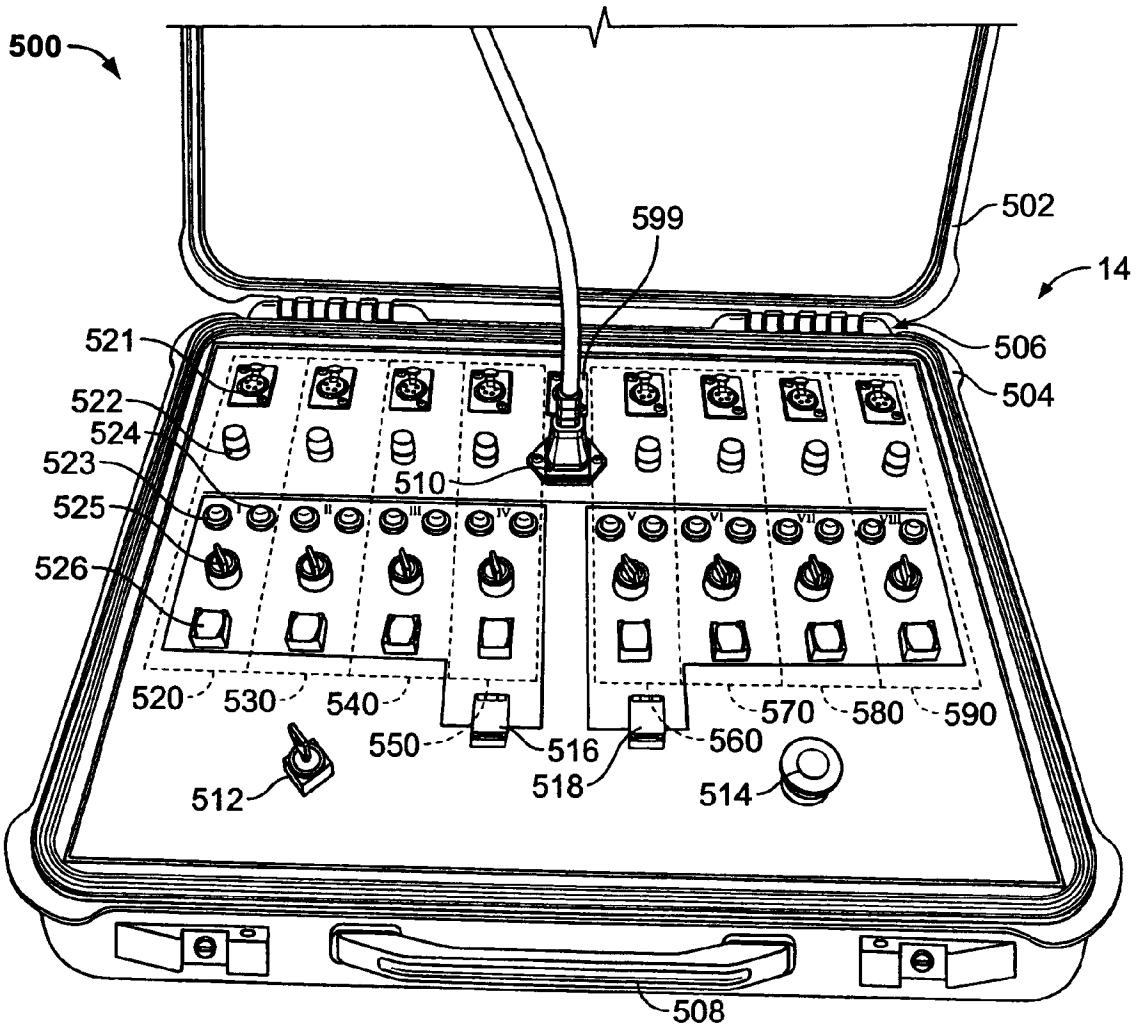
FIG. 5 is a perspective view of an example control unit for use in the system of FIG. 1.
Figure 6:
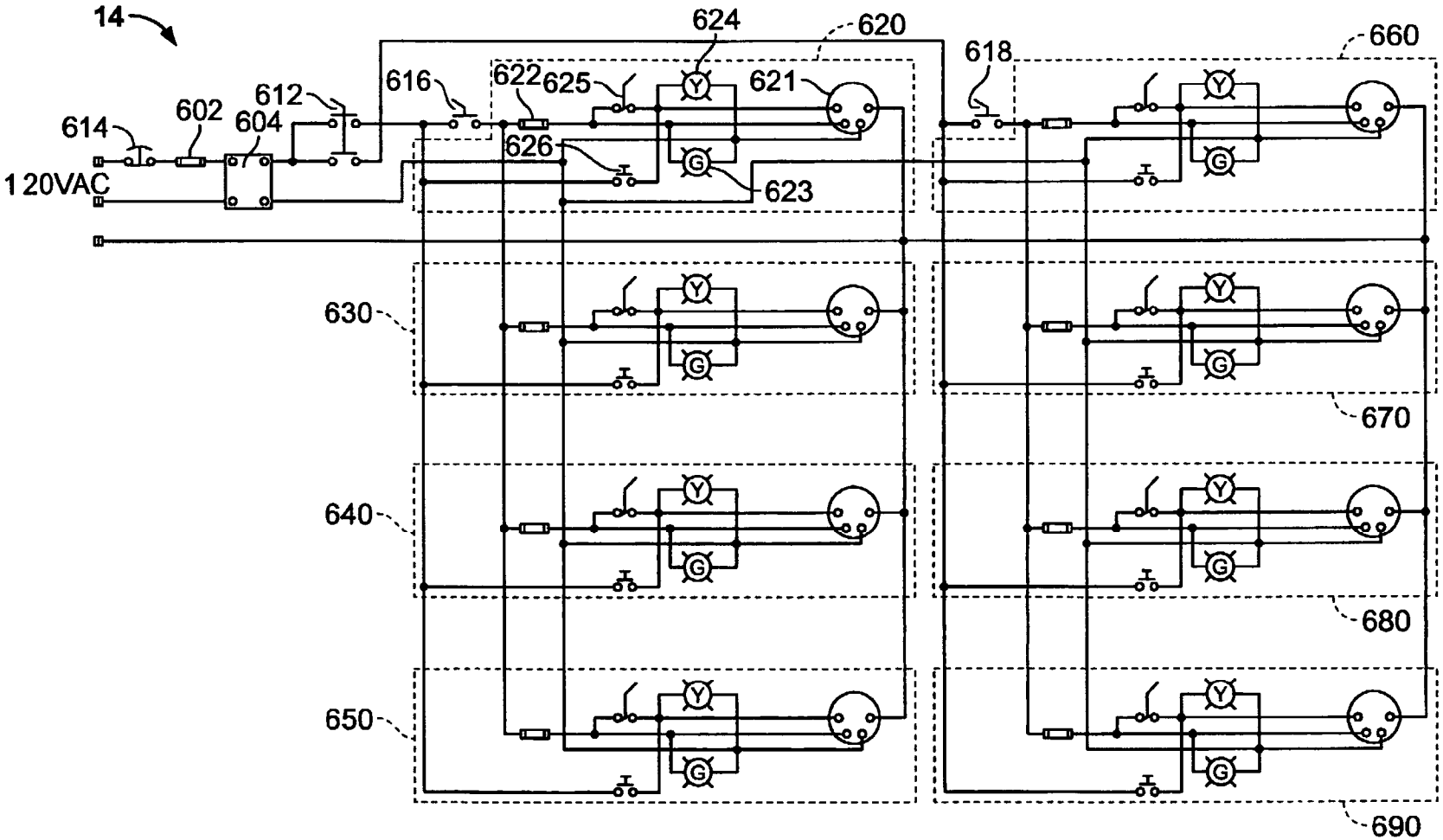
FIG. 6 is an example electrical schematic for the control unit of FIG. 5.

Turning now to FIGS. 5 and 6, the control unit 14 is described. As shown in FIG. 5, one example control unit 14 is housed in a portable case 500. The case 500 includes a top portion 502 that is connected with a bottom portion 504 via one or more hinges 506. Further, the case 500 may include a means such as a clasp, latch, lock or the like (not shown) for securing the top and bottom portions 502, 504 together and a handle 508 for carrying, transporting and handling the control unit 14. As shown, the control unit 14 is a substantially self-contained unit including a control board with an array of controls and indicators in the bottom portion 504 of case 500. The control board includes a power interface 510 for energizing the control unit 14 from a commercial power source, for example a typical 120V AC outlet. Alternatively, the control unit 14 may include an internal power source such as one or more batteries to obviate the need for an external commercial power source, thereby increasing the portability of the control unit 14.

As shown, the control board further includes a master on/off actuator 512, an emergency stop (e-stop) 514, a first activation actuator 516 for energizing a first plurality of motor control modules and a second activation actuator 518 for energizing a second plurality of motor control modules. The master on/off actuator 512 as shown is embodied by a keyed, rotatable toggle switch including a removable key to help ensure safe operation of the control unit 14 by restricting use of the control unit 14 to one or more operators having the key. The e-stop 514, as known in the art, is embodied by a high-visibility colored button and is operative to turn off the control unit 14 completely such as during a malfunction of one or more firing units 12. As shown, first and second activation actuators 516, 518 include a hinged, flip-up protective cover that prevents accidental actuation of a switch, button or the like that is disposed underneath the cover.

As can be appreciated from FIG. 5, the control board is operative to control the movement of a plurality of firing apparatuses 12. The control board includes eight modules 520, 530, 540, 550, 560, 570, 580 and 590 for operating from one to eight or more firing apparatuses 12, but fewer or additional modules may be provided. As shown, modules 520, 530, 540 and 550 are associated with first activation actuator 516 and modules 560, 570, 580 and 590 are associated with second activation actuator 518. The modules 520-590 are substantially similar and each module may be marked with indicia, for example, Roman numerals 1-8 as shown, to distinguish the modules. Only module 520 will be described hereafter in detail for simplicity since the modules 520-590 are substantially similar.

As shown, module 520 includes an output port 521, a fuse 522, indicators 523, 524, an arming actuator 525 and a momentary actuator 526. The output port 521 is embodied as a female, four-pin XLR-type port that communicates with corresponding motor control interface 62 of a firing apparatus 12 via a suitable four-wire, male/female terminated XLR cable. However, the output port 521 may be other types of ports or jacks that are known in the art, such as, for example, RJ11, RJ45, DB9, and DB25. The fuse 522 is selected to protect the module 520 and the firing apparatus 12 connected to the output port 521 from short circuit conditions, surges or the like. Alternatively, a reclosable switch such as a circuit breaker or the like may be substituted for the fuse 522. Indicators 523 and 524 are disposed in a side-by-side arrangement so that the indicators 523, 524 are generally aligned with the two positions of the actuator 525. Each indicator 523, 524 includes a light and a translucent, colored dome. Preferably, the indicators 523, 524 are two different colors to help an operator quickly identify the state of the module 520. For example, indicator 523 may be green for indicating a standby or "parked" state of the connected firing apparatus 12 whereas indicator 524 may be yellow for indicating an active or "running" state of the connected firing apparatus 12. As known in the art, the control unit 14 may additionally or alternatively include other types of indicators such as an audio indicator (e.g., speaker, buzzer, etc.) for helping an operator to determine the state of one or more of the modules 520-590.

As shown in FIG. 5, arming actuator 525, which is embodied by a rotatable toggle switch, is positioned below the indicators 523, 524. As can be appreciated, the arming actuator 525 has two positions and provides a means for arming the module 520 and the firing apparatus 12 connected to the output port 521. A leftmost position of arming actuator 525 that is generally aligned with the indicator 523 disposes the module 520 in the standby or "parked" state and illuminates the indicator 523. A rightmost position of arming actuator 525 that is generally aligned with the indicator 524 disposes the module 520 in the active or "running" state and illuminates the indicator 524. As will be discussed hereafter in further detail, arming actuator 525 and activation actuator 516 cooperate to run the firing apparatus 12 that is connected to the output port 521. That is, the control unit 14 is configured with a safety interlock such that neither the arming actuator 525 nor the activation actuator 516 may alone energize the connected firing apparatus 12 for safety reasons.

As further shown in FIG. 5, momentary actuator 526 is disposed below arming actuator 525. Momentary actuator 526 provides a means to "bump" or momentarily energize the motor 20 of firing apparatus 12 that is connected to output port 521. Thus, by actuating the momentary actuator 526, an operator may briefly test or verify proper operation of the firing apparatus 12. Further, momentary actuator 526 may be actuated by an operator or set piece designer to set the initial orientation of the firing arm 30 to achieve a desired visual effect. For example, the motor 20 of firing apparatus 12 may have a bias that returns the firing arm 30 to a predetermined standby or "parked" orientation (e.g., a leftmost orientation when viewing the front face 24*a* of the enclosure 18). Thus, momentary actuator 526 may be depressed to briefly energize the motor 20 to remotely set or adjust the firing arm 30 to a desired orientation (e.g. generally vertical) that is different from the normal parked orientation. In another example where two firing apparatuses 12 are to be arranged side to side in a mirror image fashion, one firing apparatus 12 that is on the right side may remain in the normal parked orientation whereas the second firing apparatus 12 that is on the left side may be adjusted with a momentary actuator (e.g., momentary actuator 526) so that the firing arm 30 of the second firing apparatus 12 is oriented in its rightmost orientation, generally pointing toward the first firing apparatus 12.

Although the example control board of the control unit 14 that is illustrated in FIG. 5 is operative to energize one or more firing apparatuses 12 for running their motors 20 at one predetermined rate of speed, other embodiments of the control unit 14 may include one or more means to adjust motor speed independently or collectively. In one example, each grouping of four modules 520-550 and 560-590 is provided with a potentiometer, rheostat or the like for adjusting the motor speed of the firing apparatuses 12 that are connected to those modules. In another example, each module 520-590 may include a potentiometer, rheostat or the like for adjusting the motor control voltage or current that is output from each module's output port. Thus, such speed-adjustable embodiments of the control unit 14 may provide for further flexibility in the range of visual effects that can be achieved.

One can appreciate that speed-adjustable embodiments of the control unit 14 help an operator to synchronize two or more firing apparatuses 12 that may operate slightly differently due to manufacturing variations in the motors 20 of firing apparatuses 12, electrical characteristic (e.g., resistance) differences between cables connecting the firing apparatuses 12 to the control unit 14, and the like. For example, to synchronize two firing apparatuses 12, both firing apparatuses are energized and a desired speed is set for a first firing apparatus 12. Next, the motor speed of the second firing apparatus 12 is increased or decreased as required to match the speed of the first firing apparatus. Now, once the two firing apparatuses 12 are set to the same speed, the apparatuses 12 may be parked and their firing arm 30 orientations adjusted as desired with respective momentary energizing buttons.

As further known in the art, the control unit 14 may include a means for providing a delayed frequency, intermittent or random operation of the firing apparatus 12. For example, reciprocal motors, such as the windshield wiper-type employed herein, often include an intermittent mode of operation that is user-adjustable via a rotating dial, switch or the like for selecting a delay or dwell time between arcuate sweeps.

Additionally as shown in FIG. 5, the control panel of the control unit 14 includes a lamp connection port 599.

Referring now to FIG. 6 an electrical schematic is provided in accordance with the example control unit of FIG. 5. As shown in FIG. 6, the control unit 14 includes eight motor control circuits 620, 630, 640, 650, 660, 670, 680 and 690 that correspond with modules 520, 530, 540, 550, 560, 570, 580 and 590, respectively, for operating from one to eight or more firing apparatuses 12, but fewer or additional control circuits may be provided. As shown, control circuits 620, 630, 640 and 650 are in series with first activation switch 616 that corresponds with first activation actuator 516 (FIG. 5) and control circuits 660, 670, 680 and 690 are in series with second activation switch 618 that corresponds with second activation actuator 518 (FIG. 5). As can be appreciated, the control circuits 620-690 are substantially similar and, therefore, only circuit 620 will be described hereafter in detail.

As shown, the control unit 14 is powered by a commercial power source that is a 120V AC source such as a typical three-wire GFCI outlet. In series with the power source there is a main circuit protector 602 such as a fuse, an emergency stop (e-stop) switch 614 that corresponds to e-stop button 514 (FIG. 5), a main on/off switch 612 that corresponds to keyed on/off switch 512 (FIG. 5) and a power supply 604 for providing suitable voltages and currents to the control circuits 620-690. For example, the power supply 604 may be embodied by an AC/DC converter for converting 120V AC to 12V DC. Alternatively, if the power source was a DC source (e.g., batteries) internal or external to the case 500 (FIG. 5), the power supply 604 may be embodied by a DC/DC converter for providing a near-constant output voltage to the circuits 620-690.

As further shown in FIG. 6, the control circuit 620 includes an output 621 that corresponds to output port 521 (FIG. 5), a fuse 522, indicator lights 623, 624, a switch 625 and a button 626. The output 621 includes four conductors for connection with the example four-pin XLR-type port 521 (FIG. 5). However, the output 621 may include fewer or additional conductors as needed to correspond with the selected output port 521. The example fuse 522 is selected to be a three amp fuse, but may be any suitable size and type based on the operating characteristics (i.e., current and voltage) of the firing apparatus 12 that is connected to the output port 521. As shown, lights 623, 624 are incandescent-type bulbs and correspond with indicators 523, 524, respectively. However, lights 623, 624 may alternatively be LEDs or other lights known in the art.

As shown, switch 625 is a toggle-type switch and corresponds with arming actuator 525 for activating the control circuit 620 and disposing the module 520 in the active or "running" state. As can be appreciated, power is supplied to circuits 620-650 when switches 612 and 616 are closed. When switch 625 is open, light 624 is off and light 623 is on, indicating that the circuit 620 is in the standby state. When switch 625 is closed, light 624 is on and light 623 is off, indicating that the circuit 620 is operating a firing apparatus 12 connected with the output port 521. As shown in FIG. 6, button 626 is disposed in a normally-open configuration. Now, when switch 625 is open, button 626 may be pressed thereby completing a circuit path that bypasses open switch 625 to illuminate light 624 and applying power to the output 621 for momentary energization of the motor 20 of the firing apparatus 12 that is connected with the output port 521. Thus, one can appreciate that the foregoing-described example control unit 14 operates one or more firing apparatuses 12 based on switch logic of a series of switches.

Alternatively, the control unit 14 may be embodied by an electronic controller. To this end, the control unit 14 may include a programmable logic controller (PLC), field programmable gate array (FPGA), microcontroller, microprocessor, microcomputer, state machine or other suitable electronic logic device known in the art. In this way, the control unit 14 may operate one or more firing apparatuses 12 under software control for synchronizing visual effects produced by the firing apparatuses 12 with musical cues, lighting cues and the like. For example, a control unit 14 may include a microprocessor linked with one or more pulse width modulation (PWM) modules or the like for controlling operation (e.g., speed, position, acceleration, delay, momentary pause, etc.) of the motors 20 of a plurality of firing apparatuses 12.

Figure 7:
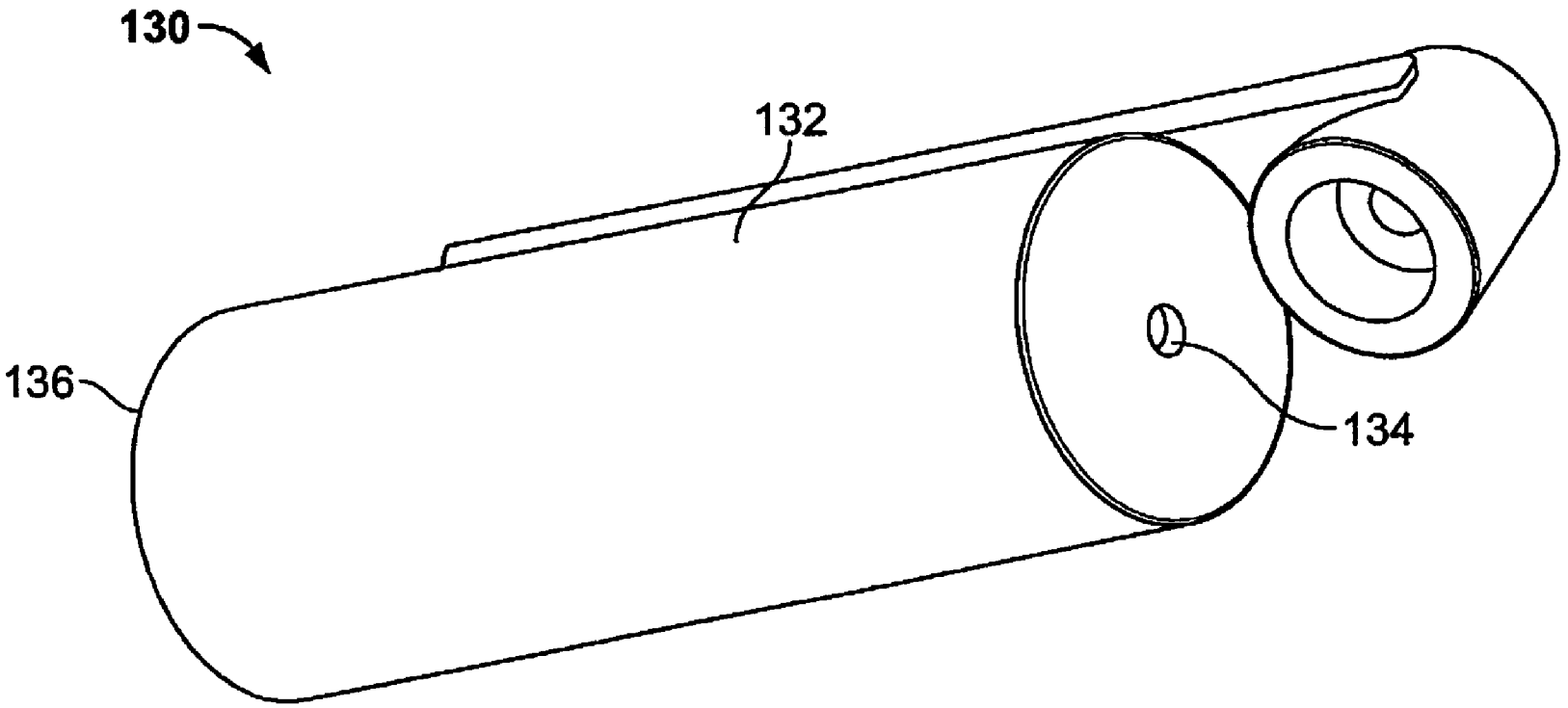
FIG. 7 is a perspective view of another example firing arm for use with the example motorized firing unit of FIG. 2.

Although the foregoing-described and illustrated example firing arm 30 employs gerbs, the firing apparatus 12 may be adapted to provide other visual special effects. For example, a firing apparatus 12 may include a firing arm that is adapted to emit one or more of the following including but not limited to: smoke, fog, bubbles, confetti, light such as laser light and other visual effects known in the art. Referring now to FIG. 7, a firing arm 130 is illustrated for emitting carbon dioxide to produce a white, fast dissipating fog or smokescreen. As shown the firing arm 130 includes a cylindrical, lengthwise portion 132 that has an aperture 134 in its proximal end (i.e., the end that couples with the motor shaft 22) for attaching thereto a flexible hose, tubing or the like (not shown) that is connected with a carbon dioxide source (not shown).

Thus, similar to the foregoing firing arm 30, the firing arm 130 moves back and forth in a reciprocating arcuate fashion when attached to the shaft 22 of the motor 20, while the flexible hose, tubing or the like feeds the cylindrical, lengthwise portion 132 with compressed carbon dioxide. The carbon dioxide moves through the lengthwise bore of the cylindrical, lengthwise portion 132 and exits the open end 136, expanding and creating a fan or wall of concentrated carbon dioxide "smoke". In this way, two firing apparatuses 12 arranged in a mirror image fashion and employing firing arms 130 could be used, for example, on opposite sides of a stage to produce a dramatic "reveal" of a performer. Indeed, a firing apparatus 12 may include a plurality of interchangeable firing arms, each of which is adapted for a different visual effect when attached to the shaft 22 of motor 20.

In view of the foregoing, the system 10 (FIG. 1) may be operated as follows:

The example firing apparatus 12 (FIGS. 2-4) is placed in a desired location and gerbs are placed in tubes 34-40 and locked in place using set screws inserted in bores 42. The ignition wires of the gerbs are attached to contacts 50 for electronic firing. Then, the control unit 14 placed in a remote location from the firing apparatus 12 and output port 521 (FIG. 5) is cabled to interface port 62 and the ignition unit 16 is placed in a remote location that may be the same or different location from the control unit 14 and is cabled to interface port 60. Once this wiring is completed, a key is inserted into switch 512 on the control panel and the switch 512 is turned to the "on" position, making the system 10 active. Next, momentary actuator 526 (FIG. 5) is pressed to power the reciprocating motor 20 to move firing arm 30 to a desired position in its arc of motion. So long as the momentary actuator 526 is pressed, current is applied to the motor 20 and the firing arm 30 moves. As soon the momentary actuator 526 is released, the motor 20 stops or parks in the then current arm orientation. In this way, the illustrated plurality of momentary actuators can be operated with a number of different firing apparatuses, each having their firing arm 30 in a different orientation in their respective arcs of movement.

Once the firing arm 30 is in the desired position, arming actuator 525 is moved from the park to the run position causing indicator light 524 to illuminate, indicating that the firing apparatus 12 is ready for operation. Now, safety cover of activation actuator 516 is moved, exposing the actuator (e.g., a pushbutton), which the operator presses when he or she is ready to commence operation of the firing apparatus. When this actuator 516 is pressed a motor control signal, voltage or current is output from port 521 to energize and control operation of the motor 20 of firing apparatus 12. As can be appreciated, since ignition of the gerbs is independent from operation of the firing apparatus 12, a second operator who controls ignition of the gerbs via ignition unit 16 may communicate with the operator of control unit 14 by, for example, a two-way radio or the like, to synchronize the ignition of the gerbs with the energizing of the motor 20 of firing apparatus 12. The emergency stop switch 514 may be pressed by an operator if something goes awry with operation of the firing apparatus 12 or igniting the gerbs. The emergency stop switch 514 will stop movement of the firing arm 30 and may also prevent any further ignition of the gerbs mounted in the firing arm 30.

Various embodiments of this invention are described herein. Variations of those example embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pyrotechnic system, comprising:

a motor having a rotatable shaft;

a firing arm including a proximal end that is attached to the rotatable shaft, a distal end adapted to receive a pyrotechnic device and a body portion including an ignition contact;

a control and firing interface including a motor control input and an ignition input, wherein the motor control input is linked with the motor and receives a signal from a control unit that is located remotely from the control and firing interface for controlling movement of the rotatable shaft and the ignition input is linked with the ignition contact of the pyrotechnic device body portion and receives a signal from an ignition unit that is located remotely from the control and firing interface for firing the pyrotechnic device; and a synchronizing element selected from the group consisting of a programmable logic controller (PLC), a field programmable gate array (FPGA), a microcontroller, a microprocessor, a microcomputer, a state machine, and hardware logic elements for operating the control and firing interface synchronously with musical cues or lighting cues.

2. The pyrotechnic firing apparatus of claim 1 wherein the motor comprises a reciprocating motor that arcuately moves the distal end back and forth through a predetermined angle.

3. The pyrotechnic firing apparatus of claim 2 wherein the predetermined angle is less than about 180°.

4. The pyrotechnic firing apparatus of claim 3 wherein the predetermined angle is approximately 90°.

5. The pyrotechnic firing apparatus of claim 3 wherein the distal end of the firing arm moves in a path through two substantially similar angles of approximately 45° that are disposed on either side of a vertical axis bisecting the part of the arm.

6. The pyrotechnic firing apparatus of claim 1 wherein the distal end is fitted with a pyrotechnic device that is selected from the group consisting of gerbs, comets, mines and flares.

7. The pyrotechnic firing apparatus of claim 1 wherein the firing interface further comprises an output for providing the signal from the control unit to another pyrotechnic firing apparatus.

8. The pyrotechnic firing apparatus of claim 1 wherein the firing arm is adapted to emit a visual effect selected from the group consisting of smoke, fog, bubbles, confetti and light.

9. The pyrotechnic firing apparatus of claim 1, further comprising a control element for providing a delayed frequency, intermittent, or random operation of the firing apparatus.

10. The pyrotechnic firing apparatus of claim 9, wherein the control element is selected from the group consisting of a user-adjustable rotating dial and a switch.

11. The pyrotechnic system of claim 1, further comprising one or more further apparatuses connected to the synchronizing element for operation synchronously with musical cues or lighting cues.

12. A pyrotechnic system, comprising:

a motor having a rotatable shaft;

a firing arm including a proximal end that is attached to the rotatable shaft, a distal end adapted to receive a pyrotechnic device and a body portion including an ignition contact;

a control and firing interface including a motor control input and an ignition input, wherein the motor control input is linked with the motor and receives a signal from a control unit that is located remotely from the control and firing interface for controlling movement of the rotatable shaft and the ignition input is linked with the ignition contact of the pyrotechnic device body portion and receives a signal from an ignition unit that is located remotely from the control and firing interface for firing the pyrotechnic device; and a synchronizing element comprising a microprocessor that is linked with one or more pulse width modulation (PWM) modules for controlling operation of motors of a plurality of firing apparatuses for operating the control and firing interface synchronously with musical cues or lighting cues.

13. The pyrotechnic system of claim 12, wherein the operation of the motors is selected from the group consisting of speed, position, acceleration, delay, and momentary pause.

14. A pyrotechnic system comprising:

a first firing apparatus including a reciprocal motor, a firing arm having a first end connected to a shaft of the reciprocal motor and a second end adapted to emit a pyrotechnic effect of a gerb or other pyrotechnic device;

a second firing apparatus separated from the first firing apparatus by a distance that is slightly less than twice a predetermined shower height of the pyrotechnic effect;

a control unit in communication with the firing apparatuses for controlling operation of the reciprocal motor; and an ignition unit in communication with the firing apparatus for initiating the pyrotechnic effect, wherein the first and second firing apparatuses are arranged in a mirror-image fashion such that the arm of the first firing apparatus is initially oriented toward the second firing apparatus and the arm of the second firing apparatus is initially oriented toward the first firing apparatus, the gerbs or other pyrotechnic devices of the first and second firing apparatuses being operable so that when they are ignited and the motors are energized and operated together, the showers of the gerbs or other pyrotechnic devices move in an arcuate fashion generally upward and downward to form converging and diverging fans of sparks and flame.

* * * * *